US005165710A

United States Patent [19]

Runyon

[11] Patent Number: 5,165,710

[45] Date of Patent: Nov. 24, 1992

[54] SKATEBOARD DEVICE

[76] Inventor: Arthur Runyon, 7050 Shoup Ave., #173, Canoga Park, Calif. 91303

[21] Appl. No.: 811,372

[22] Filed: Jan. 24, 1992

Related U.S. Application Data

[63] Continuation-in-part of Ser. No. 502,904, Apr. 2, 1990, abandoned.

[51] Int. Cl.[5] ..... A63C 17/01

[52] U.S. Cl. ..... 280/87.042; 280/217

[58] Field of Search ..... 280/87.041, 87.042, 280/87.043, 87.021, 87.01, 217, 215; 180/76, 165

[56] References Cited

U.S. PATENT DOCUMENTS

| | | | |
|---|---|---|---|
| 1,318,374 | 10/1919 | Gilbert | 280/217 |
| 1,503,009 | 7/1924 | Savage | 280/215 |
| 2,935,899 | 5/1960 | Nallinger | 180/165 |
| 4,176,850 | 12/1979 | Johnson | 280/11.28 |
| 4,194,752 | 3/1980 | Tilch et al. | 280/87.042 |
| 4,337,961 | 7/1982 | Covert et al. | 280/87.042 |

*Primary Examiner*—Eric D. Culbreth

*Attorney, Agent, or Firm*—John J. Posta, Jr.

[57] ABSTRACT

The skateboard device includes a board of extended surface area adapted to support a skateboard rider, a pair of spaced front and rear wheels connected to the underside of the board, a relatively massive rotor disposed for rotation in a housing connected to the underside of the board adjacent either the rear or front wheels, preferably the rear wheels, and a gear assembly in the housing interconnecting the rotor and wheels which are adjacent thereto. With this arrangement, when the skateboard is pushed to start it up, the inertia of the rotor is overcome as energy is transferred from the geared wheels through the gear assembly to the rotor to cause it to rotate in the housing. When a sufficient or desired speed for the skateboard is reached, the skateboarder climbs aboard and glides along, the stored energy in the rotational momentum of the rotor being transferred back to the interconnected geared wheels, causing a smoother, longer ride than is attainable without the rotor. The front wheels may pivot and the rear wheels may independently operate through separate axles. A shock-absorbing skid member can be attached to the housing to protect the gear assembly.

14 Claims, 2 Drawing Sheets

SKATEBOARD DEVICE

This is a continuation in part, of application Ser. No. 07/502,904, filed Apr. 2, 1990, now abandoned.

BACKGROUND OF THE INVENTION

1. Field of the Invention

The present invention generally relate to sports devices and more particularly to a skateboard device of an improved type.

2. Prior Art

The usual types of skateboards comprise flat board, to the undersides of which are mounted spaced pairs of front and rear wheels. Certain improvements have been made in skateboards, such as forming them of moulded or cost aluminum, plastic or the like in a lattice-work light weight but strong configuration, as is described in U.S. Pat. No. 4,337,963, and in improving the suspension of the wheels, as in U.S. Pat. No. 4,194,752. Little has been done, however, to otherwise improve the smoothness, ease of operation and length of travel of the skateboard in use. There remains a need for an improvement which will favorably affect the operational characteristics of the skateboard, and particularly will allow it to more smoothly traverse a greater length of roadway, that is, will improve its coastability. Such an improvement should be compact, durable, inexpensive and light in weight and should not require any different types of handling of the skateboard than is conventional.

SUMMARY OF THE PRESENT INVENTION

The improved skateboard device of the present invention satisfies all the foregoing needs. Thus, the device comprises a modified conventional skateboard; that is, a board of extended surface area, to the bottom of which are attached spaced pairs of front and rear wheels. However, the device includes a novel rotor of extended surface area and mass rotatably disposed in a housing connected to the underside of the board adjacent one pair of the wheels, preferably the rear wheels.

The housing also includes gears which interconnect the rotor and the adjacent pair of general wheels. A preferred embodiment includes a pair of bevel gears, each of which connects to an angled driver gear, in turn keyed to a ring gear and differential gear array, with independent wheel axles in the housing running to the two wheels. Those wheels act independently for optimal turning and stability. The other pair of wheels, such as the front wheels can be pivotally mounted for easier steering of the skateboard.

When the skateboard is pushed by one leg of the rider, the inertia of the large rotor is overcome and the geared wheels and rotor begin to turn faster and faster, until it is desired to coast on the skateboard, at which point the rider ceases pushing and climbs fully aboard the skateboard. The rotor now helps to drive the geared wheels, due to the energy of rotational momentum built up in the rotor. This results in a longer, smoother, more satisfying coasting ride with slower changes in speed than without the rotor. Moreover, the rotor helps stabilize the skateboard against tipping over, having a gyroscopic-like effect.

If desired, a skid member can be secured to one end of the housing to protect the geared assembly from shocks by transmitting impacts with ground objects directly to the board.

Other features of the improved skateboard device of the present invention are set forth in the following detailed description and accompanying drawings.

DRAWINGS

DETAILED DESCRIPTION

Figures 1–4

Figure 1:
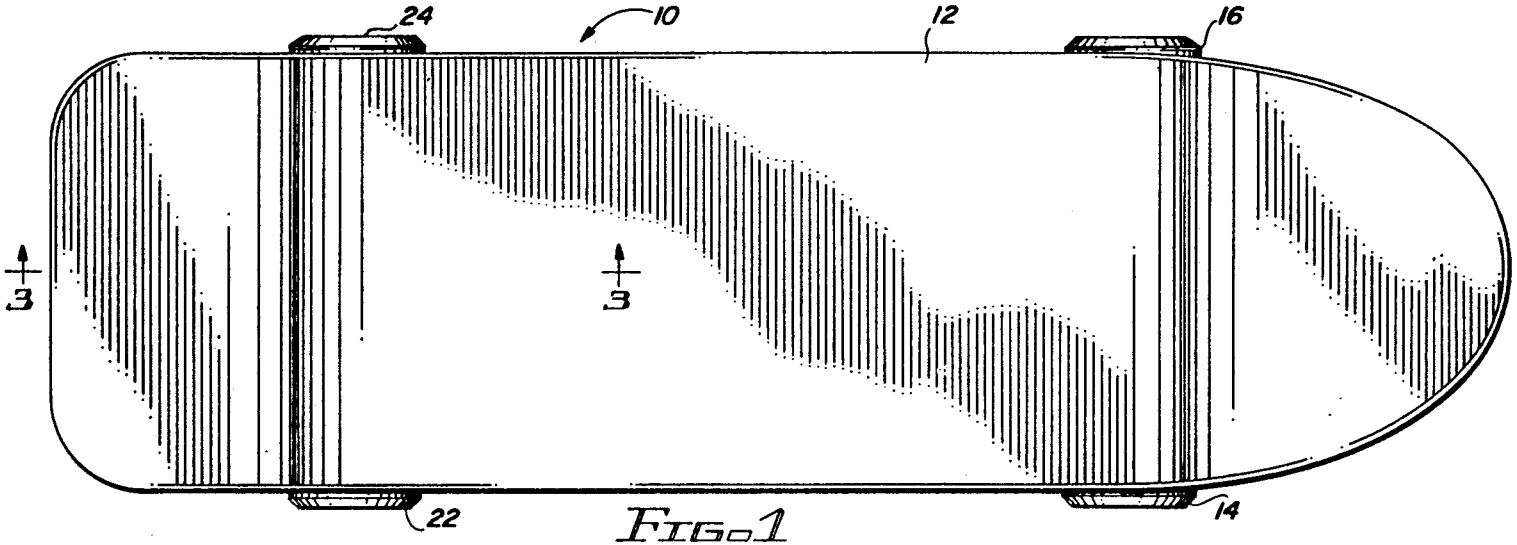
FIG. 1 is a schematic top plan view of a preferred embodiment of the improved skateboard device of the present invention.
Figure 2:
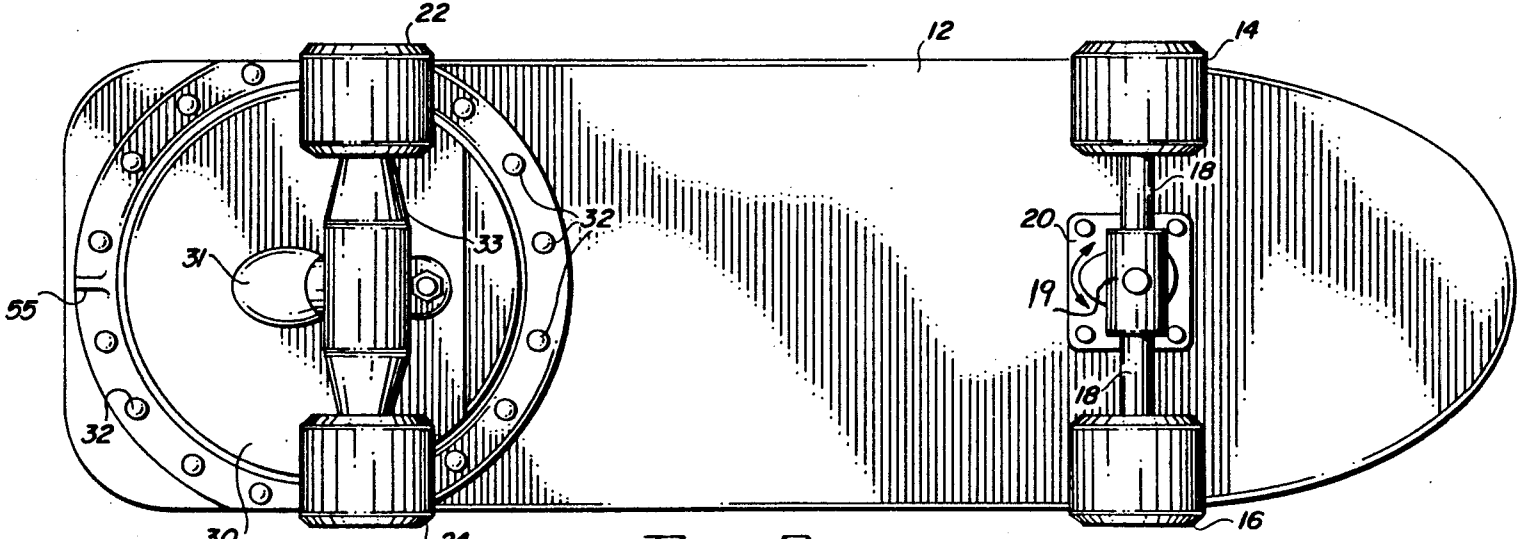
FIG. 2 is a schematic bottom plan view of the skateboard device of FIG. 1 of the present invention; and, FIG. 3 is an enlarged, fragmentary schematic side elevation, partly broken away and partly in section, of rotor-gear wheel array of the skateboard device of FIG. 1.
Figure 3:
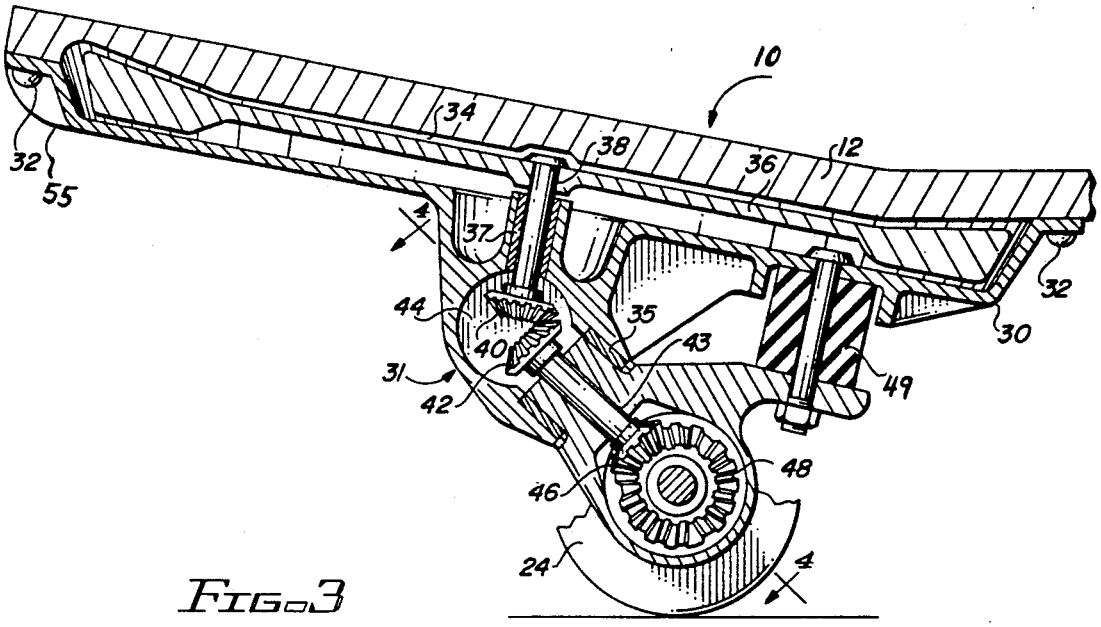
Figure 4:
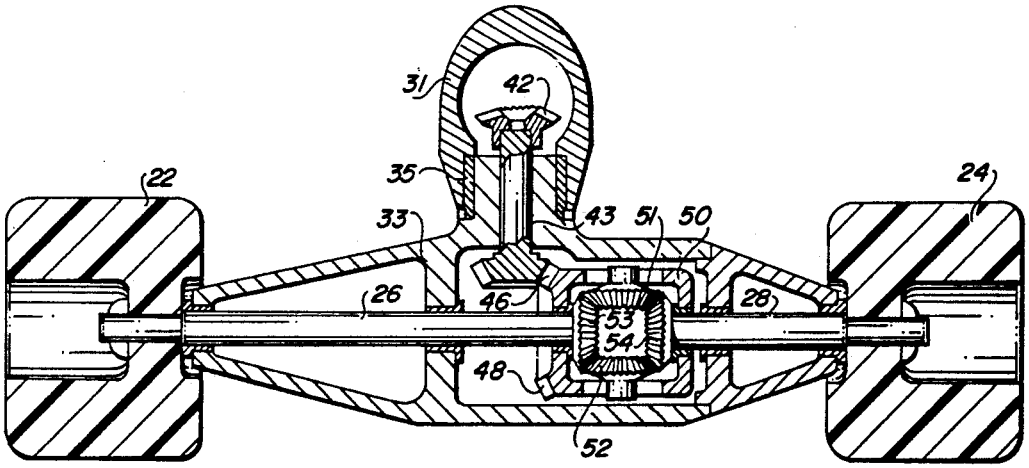
FIG. 4 is an enlarged, fragmentary schematic section view taken from FIG. 3 as indicated.

Now referring more particularly to the drawings, a preferred embodiment of the improved skateboard device of the present invention is schematically depicted therein. Thus, skateboard device 10 is shown which comprises a generally flat elongated board 12 of wood, plastic, metal or the like having an extended surface area generally extending horizontally and supported above the ground by a pair of front wheels 14 & 16 of metal, plastic, etc., interconnected pivotally by a bracket 20 to the underside of board 12 via axle 18 and truck 19 in such a manner as to facilitate turning of the skateboard left or right as the rider shifts weight to the left or right, respectively.

Device 10 also includes a rear pair of wheels 22 and 24 of metal or plastic, etc., connected to separate independent axles 26 & 28, respectively. A housing 30 is connected to the underside of board 12 by a ring of spaced bolts 32, and configured to help stiffen it and support board 12. The upper part of housing 30 defines a space 34 within which a large dimension rotor 36 is secured to a stem 38 for rotation therewith in bearing 37. The diameter of rotor 36 may be, for example, $\frac{1}{4}$ to $\frac{1}{3}$ the length of board 12.

The lower end 40 of stem 38 is connected to stem 43 through a universal joint (not shown) or with bevel gear 42 in a lower space 44 in sub-housing 31 which is integral with housing 30. Bevel gear 42 is connected to a driver gear 46 which is keyed to ring gear 48 connected within a differential gear box 50 to which axles 26 and 28 are keyed for rotation of wheels 22 and 24, respectively. The truck 33 contains and supports the differential gear box 50 and axles 26 and 28 and wheels 22 and 24. Truck 33 is supported by bearing 35 mounted in sub-housing 31 and pivots in bearing 35 so as to facilitate turning of the skateboard. The axis of the bearing 35 is inclined at such an angle to facilitate turning of the skateboard when the rider shifts weight to either left or right so as to cause a left or right turn, respectively. Since the stem 43 is aligned along this same axis, the rotation of rotor 36, stem 38 and stem 43, and gears and axles 26 and 28 and wheels 22 and 24 are not interferred with by the action of turning the skateboard left or right. Brackets or flexible post 49 help cushion and support the truck 33.

Differential gear box 50 contains idler gears 51 and 52 which transfer torque to gears 53 and 54 mounted on axles 26 and 28, respectively. The action of the four bevel gears 51, 52, 53 and 54 is such as to transmit torque to and from the rotating system of stems 43 and 38 and rotor 36 while allowing axles 26 and 28 to rotate at different speeds, the amount of increase in the faster being equal to the decrease in the slower. By this means the turning of the skateboard is facilitated without binding or causing slipping of either wheel 22 or 24 relative to the ground, it being necessary for the increase in rotational speed of the wheel on the outer side of a turn to be equal to the decrease in rotational speed of the wheel on the inner side of the turn.

With the described arrangement, forcible rotation of wheels 22 and 24, as by pushing device 10 with one leg while the rider supports himself thereon with the other leg, causes the inertia of rotor 36 to be overcome and rotor 36 to rotate with wheels 22 and 24, as through the described gearing array. Although rotation of rotor 36 may be somewhat difficult initially as its speed picks up, the force necessary to push device 10 decreases. When the desired skateboard speed is reached, the rider puts full weight on the skateboard and coasts. The stored energy in the form of turning mementum or rotational torque in rotor 36 is delivered back to wheels 22 and 24 through the gear array, causing them to coast skateboard 10 for a much longer time and with a smoother motion than would be the case without rotor 36.

Moreover, rotor 36 acts as a stabilizer for device 10, being a rotating mass positioned over a wide area immediately below board 12. Once maximum coasting speed is reached, rotor 36 helps keep device 10 near this speed for an appreciable period of time, with only an occasional leg push being needed to bring skateboard device 10 up again to full speed. It should be noted that the full strength energy potential of the skateboard can be used by device 10. Thus, pushing of device 10 can be continued until a maximum of stored energy is obtained, while skateboard 10 is still at a controllable pushed speed. This is an additional advantage over rotorless conventional skateboards.

A skid 55, integral with housing 30, serves to protect the geared assembly from shock by transferring impacts with ground objects directly into board 12. Skid 55 can be secured to housing 30 by any well known fastening means.

Housing 30, which acts as a brace for board 12 and wheels 22 and 24 while holding the gear and axle array in place, preferably is fabricated of metal, but can also be made of high strength plastic or the like. The remaining components can also be fabricated of metal, although board 12, flex posts 49, skid 55 and wheels 14, 16, 22 and 24 normally are of various types of plastic, rubber or the like.

Various other modifications, changes, alterations and additions can be made in the improved skateboard device of the present invention, its components and their parameters. All such modifications, changes, alterations and additions as are within the scope of the appended claims form part of the present invention.

What is claimed is:

1. An improved skateboard device, said skateboard device comprising, in combination:

a) a board adapted to support a skateboard rider;

b) spaced front and rear rotatable wheels connected to said board for supporting said board;

c) a rotor lying in a plane substantially parallel to the plane of said board and disposed for rotation in a housing connected to said board adjacent either said front wheels or said rear wheels; and, d) differential gear means in said housing connected to said rotor and to said wheels which are adjacent to said rotor, whereby rotation of said rotor or said geared wheels adjacent thereto effects rotation of the other of said rotor and said geared adjacent wheels for smoother, more continuous skateboarding.

2. The improved skateboard device of claim 1 wherein said device has a pair of rear wheels interconnected to said rotor by said gear means.

3. The improved skateboard device of claim 2 wherein said device includes a pair of front wheels rotatably secured to said board for steering said device.

4. The improved skateboard device of claim 3 wherein said device includes a pair of independent rear axles with said rear wheels mounted thereon.

5. The improved assembly of claim 1, including skid means secured to said skateboard to protect said gear means.

6. An improved skateboard assembly comprising, in combination:

a) a board, b) a plurality of wheels rotatably secured to said board; and, c) a rotor lying in a plane substantially parallel to the plane of said board and connected to at least one of said wheels which serves as a flywheel to store energy therein for later release to the skateboard assembly; and, d) differential gear means interconnecting said wheels and rotor, whereby rotation of said rotor or said wheel at least one of said effects rotation of the other of said rotor and said wheels for smoother, more continuous skateboarding.

7. The improved skateboard of claim 6 wherein gear means are employed to connect said rotor to said wheel.

8. The improved skateboard assembly of claim 7 wherein said device has a pair of rear wheels interconnected to said rotor by said gear means.

9. The improved skateboard assembly of claim 8 wherein said device includes a pair of front wheels rotatably secured to said board for steering said device.

10. The improved skateboard assembly of claim 8 wherein said device includes a pair of independent rear axles with said rear wheels mounted thereon.

11. The improved assembly of claim 6 wherein said device has a pair of rear wheels interconnected to said rotor by said gear means.

12. The improved assembly of claim 11 wherein said device includes a pair of front wheels rotatably secured to said board for steering said device.

13. The improved assembly of claim 12 wherein said device includes a pair of independent rear axles with said rear wheels mounted thereon.

14. The improved assembly of claim 6 including skid means secured to said skateboard to protect said gear means.

* * * * *